US005163824A

United States Patent [19]

Kantner

[11] Patent Number: 5,163,824

[45] Date of Patent: Nov. 17, 1992

[54] RUBBER-GEARED PUMP WITH SHAFTLESS GEAR

[75] Inventor: Harold H. Kantner, Evanston, Ill.

[73] Assignee: Transcience Associates Inc., Evanston, Ill.

[21] Appl. No.: 831,185

[22] Filed: Feb. 6, 1992

Related U.S. Application Data

[63] Continuation-in-part of Ser. No. 489,056, Apr. 23, 1990, abandoned.

[51] Int. Cl.[5] ..... F04C 2/08; F04C 13/00

[52] U.S. Cl. ..... 418/153; 418/156; 418/179; 418/206

[58] Field of Search ..... 418/151, 153, 156, 179, 418/206

[56] References Cited

U.S. PATENT DOCUMENTS

| | | | |
|---|---|---|---|
| 1,897,560 | 2/1933 | Lawser | 418/206 |
| 2,530,767 | 11/1950 | Hamill | 418/153 |
| 2,567,699 | 9/1951 | Devlin | 418/153 |
| 2,633,083 | 3/1953 | Smith | 418/153 |
| 2,936,717 | 5/1960 | Källe | 418/206 |
| 3,039,398 | 6/1962 | Michelis | 418/153 |
| 3,881,849 | 5/1975 | Commarmot et al. | 418/206 |
| 4,249,750 | 2/1981 | Kantner | 418/61 P |

FOREIGN PATENT DOCUMENTS

| | | | |
|---|---|---|---|
| 2351285 | 12/1977 | France | 418/153 |
| 2115875 | 9/1983 | United Kingdom | 418/156 |

*Primary Examiner*—Richard A. Bertsch
*Assistant Examiner*—David L. Cavanaugh
*Attorney, Agent, or Firm*—Francis J. Bouda

[57] ABSTRACT

A gear pump is described for pumping extremely low volumes of fluid at extremely low rates of flow. The pump includes a housing with a cavity therein and a pair of gears rotatable within said cavity. One of the gears is shafted and the other is shaftless, and the gears are made of resilient material with the diameter of the periphery of the tips of the gear teeth exceeding the diameter of the cavity in which they rotate. The face width of the gears also exceeds the depth of the cavity in which they rotate.

6 Claims, 5 Drawing Sheets

EXPERIMENTAL MICROFLOW CHEMICAL PUMP
MICROSCALE ROTORS: FLUOROCARBON RUBBER COMPOSITION

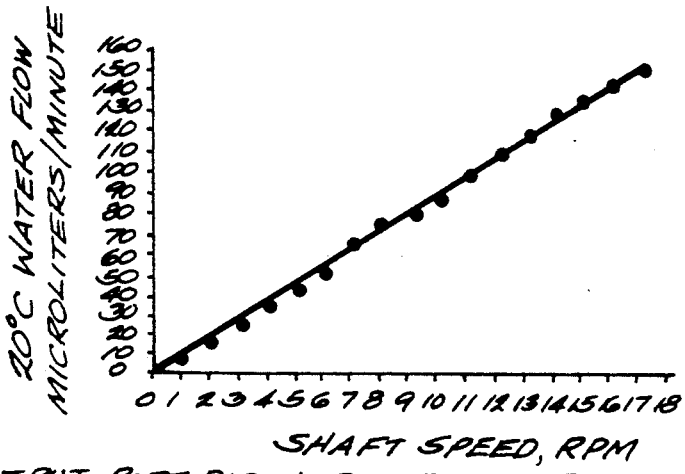

Fig. 5

OUTPUT PORT DISCHARGE FLOW AT ZERO PRESSURE HEAD
FLOW VS. ROTATIONAL SPEED PERFORMANCE

EXPERIMENTAL MICROFLOW CHEMICAL PUMP
MICROSCALE ROTORS: FLUOROCARBON RUBBER COMPOSITION

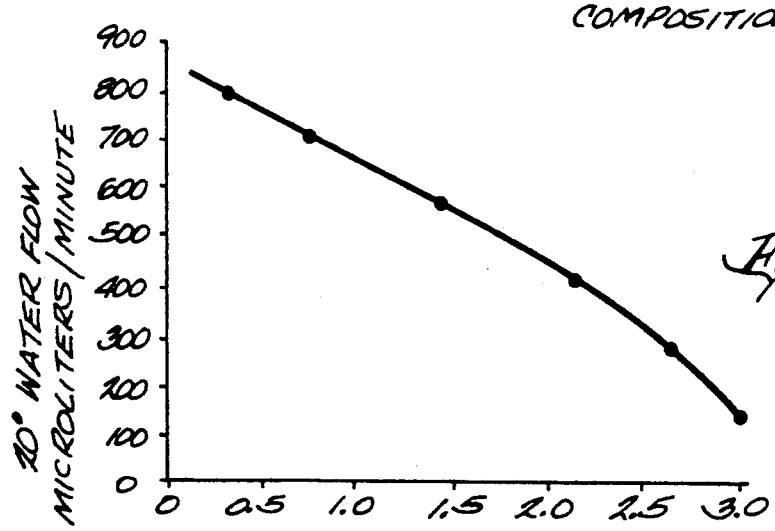

Fig. 6

OUTPUT PORT DISCHARGE PRESSURE, PSIG
SHAFT SPEED MAINTAINED CONSTANT AT 50 RPM
FLOW VS. PRESSURE PERFORMANCE

EXPERIMENTAL HIGHFLOW ELASTOGEAR™ CHEMICAL PUMP
WIDE FACE ROTORS: SANTOPRENE THERMOPLASTIC ELASTOMER

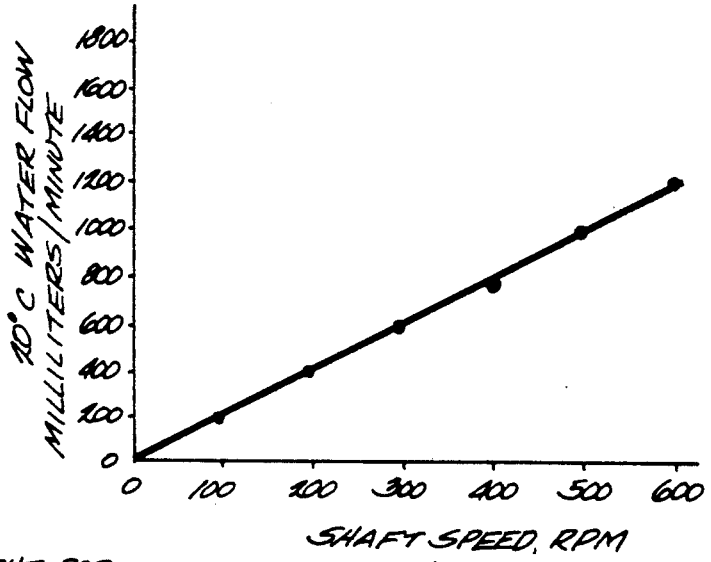

Fig. 7

OUTPUT PORT DISCHARGE FLOW AT ZERO PRESSURE HEAD
FLOW VS. ROTATIONAL SPEED PERFORMANCE

EXPERIMENTAL HIGHFLOW ELASTOGEAR™ CHEMICAL PUMP
WIDE FACE ROTORS: SANTOPRENE THERMOPLASTIC ELASTOMER

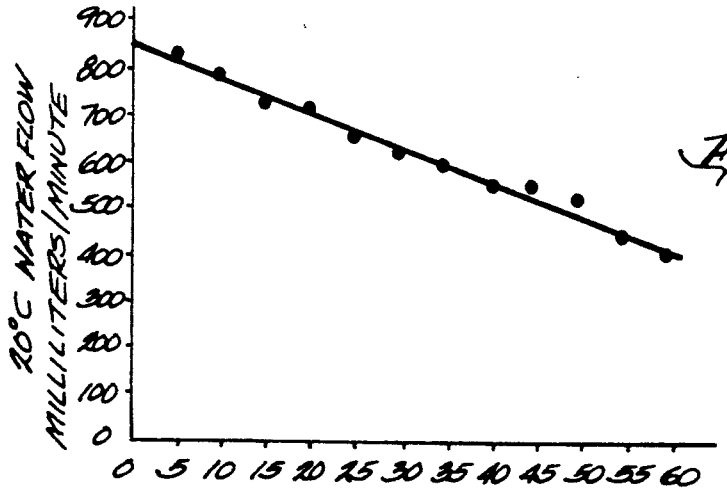

Fig. 8

OUTPUT PORT DISCHARGE PRESSURE, PSIG
SHAFT SPEED MAINTAINED CONSTANT AT 400 RPM
FLOW VS. PRESSURE PERFORMANCE

RUBBER-GEARED PUMP WITH SHAFTLESS GEAR

This application is a continuation of application Ser. No. 07/489,056 filed Apr. 23, 1990, now abandoned.

BACKGROUND OF THE INVENTION

This invention relates to improvements in rotary gear pumps, more particularly to sealing means and arrangements in a rubber-geared pump to substantially isolate the inlet side from the outlet side thereof.

Theoretically, rotary positive displacement pumps, e.g., gear pumps, discharge a constant liquid volume per revolution. However, practically, they exhibit slip defined as leakage of fluid from the high pressure to the low pressure side through clearances between the meshed gears and between the rotating elements and the stationary pump housing. A gear pump with large clearances, because of machining tolerances or wear, exhibits a proportionally large slip. For a specific pump, the retrograde flow varies directly as the pressure differential across the pump and inversely as the fluid viscosity.

Precision displacement of thin liquids with volumes and flows measured in microliters and microliters per minute is increasingly important in laboratory and industrial procedures and instruments. Most conventional gear pumps formed with rigid materials, including plastics, incorporate clearances measured in thousandths of an inch between closely proximate elements in relative motion. Thus, they are most useful for viscous lubricating liquids such as oil and are generally operated at rotational speeds above 500 rpm. As shaft speed or pump displacement is decreased to meet microflow requirements, slip becomes a larger proportion of total pump capacity. Precise pump-controlled flow of thin liquids at low rotor speed is a difficult technical problem solved by this invention.

The term "rubber" usually denotes thermoset molded vulcanized material. "Elastomer" is a more general term for elastic materials including injection molded thermoplastic materials such as SANTOPRENE (a trademark of Monsanto), an elastomeric alloy.

The invention resides in a novel sealing arrangement comprising a compressively meshed pair of elastomeric gears (an axially self-balancing shafted driver and a shaftless driven gear which is self-balancing with respect to all forces acting on it) each of which rotates in compressive contact with the rigid interior surface of a gear pump chamber partitioned by the contacting gears such that the entire gear pump device comprises a dynamic seal between fluid input and output ports and thus provides precisely metered flow linearly proportional to rotational speed of the drive shaft down to zero revolutions per minute.

The prior art fails, however, to teach the rotary gear pump of the present invention designed for low-speed, low-flow capabilities. Those capabilities result from the provision of interference fits between elastic and rigid components of the rotary pump assembly.

OBJECTS OF THE INVENTION

Therefore, one object of the present invention is to provide a rotary pump for handling extremely low rates of fluid flow and very small dispensed volumes.

A further object of the present invention is to provide a rotary pump of the gear type, wherein tooth tips of the gears are in interference-contact with the inner surface of the cavity within which the gears rotate and ends of the gears also are in interference contact with closure surfaces at the cavity ends.

Still a further object of the present invention is to provide a readily controllable microflow metering pump capable of pulse-free flow.

A primary design objective has been to facilitate automation of microanalytical chemical procedures and process chemistry: having capability rapidly and precisely to aspirate and dispense microliter volumes for automated sampling and titration, for cytometry, and for automatic diagnostic machinery.

SUMMARY OF THE INVENTION

The polymeric gear pump of the present invention is designed for precision pumping of gases and liquids under programmed control. Dispensed volumes and metered flows in the range of microliters and microliters per minute are encompassed. Easily interchanged pump rotors and housings are formed of mix-and-match chemically resistant polymers to handle virtually any solvent or solution.

This is a low pressure rotary gear type pump which excels over peristaltic and diaphragm types for operations within an intended operating regime. The smallest unit to be described has an internal volume of 45 microliters (including port tubes) and controls non-pulsatile flow at about 10 microliters per minute per shaft rpm. Larger roll/gear pumps are known (U.S. Pat. No. 4,249,750) which range in flow capacity to two liters/-minute and pressure capacity to 100 psi. Gear pumps of the present invention have been scaled up to yield comparable performance.

The pump of the present invention is particularly effective for association with digital drivers because of the unique capability of these precision metering/dispensing pumps for programmed control. They are easily synchronized to rotating machinery. For general laboratory usage, the pump is operable via a keyboarded microprocessor driver/controller which may receive commands also from a host computer.

Alternatively, mounting adapters may be used for direct attachment of this rotary (0 to 600 rpm) positive displacement pump to any existing driver/controllers such as are used for peristaltic pumps. It is expected that this polymer pump will prove useful for general laboratory applications, for flow injection analysis (FIA), a solution handling technique that manipulates small volumes of solution in a reproducible manner, and for computer controlled sampling, dosage, and makeup in many batch and continuous processes including fermentation and other bioreactor functions.

Among features of this pump is pulsation-free steady flow which is variable linearly with 0–600 rpm shaft speed. Thus proportion and gradient control are easily achieved. The pump is reversible and valveless, but the compressively engaged elastomeric rotors restrict blackflow or siphonage when stoped. Its abrupt shut-off characteristic, when driven by a stepping motor, makes the pump ideal for programmed operation.

Significant applications in biotechnology and industrial flow process automation are contemplated for this flow control and dispensing pump.

During extended life testing with water of the roll-/gear pumps of my prior invention shown in U.S. Pat. No. 4,249,750, many thermoset elastomer gears formulated and molded in various compounds, sizes, and hardnesses failed prematurely due to self-abrasive wear or gear tooth fatigue or both. Substitution of SAE 30 oil as a librication pumped medium yielded far more durable performance. Although these pumps easily exceed 40 psi capability, most of the testing was done with low viscosity, poor lubricating media against only a few psi pressure head.

Another development, a large (2 liters/minute) roll-/gear pump equipped with thermoplastic elastomeric gears, was tested [has been undergoing water tests] more or less concurrently but much more extensively and with great success.

Tests of several prototype pumps of the present invention, with paired gears installed, demonstrated only marginal performance until the [gear with] idler gear, having a stub shaft, was replaced by one with the shaft cut off and ground to be flush with the end surface of the rubber gear. With that substitution, the flow performance of the microflow pump was much improved. A possible explanation is self-balancing of the "floating" idler gear with respect to all forces acting on it.

With the above and other considerations on view, more information and a better understanding of the present invention may be achieved by reference to the following detailed description.

DETAILED DESCRIPTION

For the purpose of illustrating the invention, there is shown in the accompanying drawings a form thereof which is at present preferred, although it is to be understood that the several instrumentalities of which the invention consists can be variously arranged and organized and that the invention is not limited to the precise arrangements and organization of the instrumentalities as herein shown and described.

In the drawings wherein like reference characters indicate like parts:

FIG. 5 is a graph of the Flow vs Rotative Speed capability of the pump of the present invention when equipped with microscale rotors and driven by a gear-head stepping motor.

FIG. 6 is a graph of Flow vs Pressure Performance of the pump of the present invention when equipped with microscale rotors.

FIG. 7 is a graph of Flow vs Rotative Speed of the pump of the present invention when equipped with relatively large rotors.

FIG. 8 is a graph of Flow vs Pressure Performance of the pump of the present invention when equipped with relatively large rotors.

Figure 1:
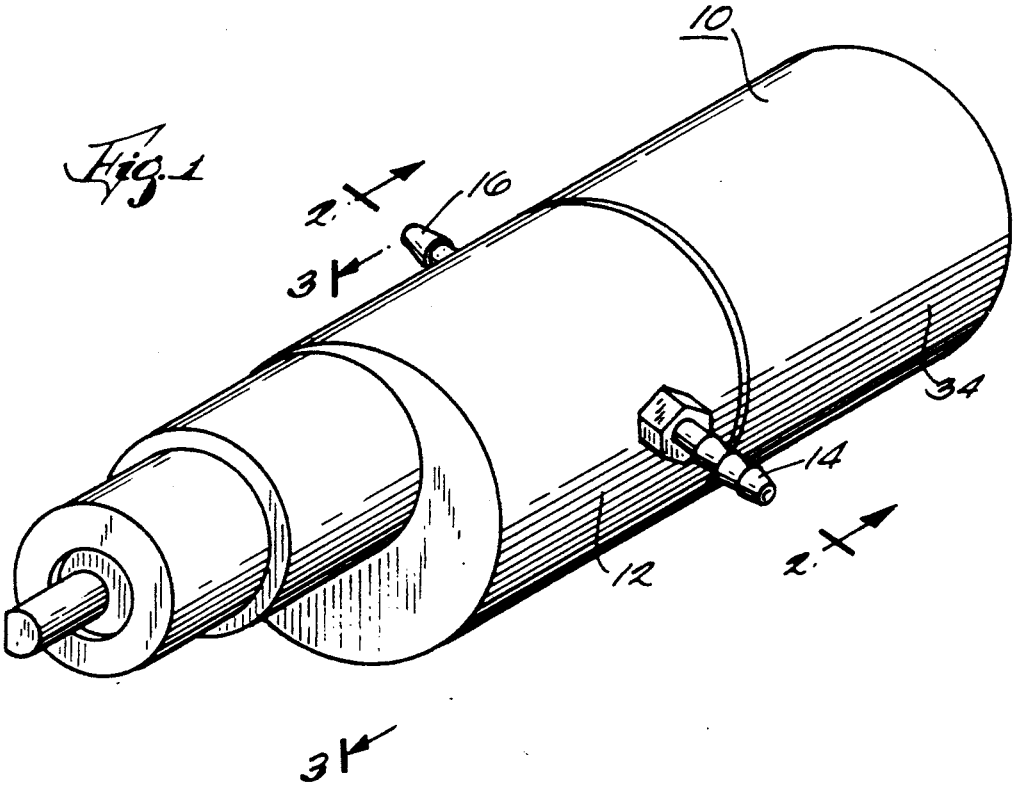
FIG. 1 is a perspective view of the elastomer gear microflow rotary pump of the present invention.

In FIG. 1, the elastomer gear microflow rotary pump 10 includes a housing 12 with a cavity 11 formed therein.

An inlet port 13 with a suitable coupling 14 provides an entry of fluid from a reservoir (not shown) to the cavity 11.

A discharge port 15 with its suitable coupling 16 provides a conduit through which fluid may be discharged from the cavity 11.

A pair of toothed rotors 17 and 18 fit within the cavity 11 in a fluid-tight contact at the interface 19 along the rotor face.

Each of the gears 17 and 18 is of a size where the tips 20 of the driver gear 17 and the tips 21 of the passive gear 18 are in interfering contact with the inner surface 22 of the cavity 11.

The driver gear 17 has a shaft 23 press-fitted into tight contact with a rigid core 46 in gear 17, or bonded directly to the gear material.

The passive or driven gear 18 does not rotate on a shaft, but because of its tight spacement within the walls 22 of its surrounding cavity the gear axis 24 is constantly parallel with the axis 25 of the shaft 23 of the driver gear 17.

At the end 26 of the shaft 23 which extends beyond the gear 17 a slot 27 is formed to receive a tongue 28 of a shaft 29 which is connected to any suitable power source or motor (not shown). This type of connection enables driver gear 17 to balance its end forces and isolates it from axial thrust of shaft 29.

The shaft 29 to which is fixed collar 32, rotates in appropriate bearings 30, which are held in place by a retaining ring 31. The collar 32 restricts axial motion of shaft 29 and thus prevents thrust propagation to gear 17. A cup type shaft seal 33 is contained behind the innermost bearing.

At the opposite end of the assembly, a cap 34 is screw-assembled by the threaded portion 35 onto the threads 36 of the housing 12.

Figure 3:
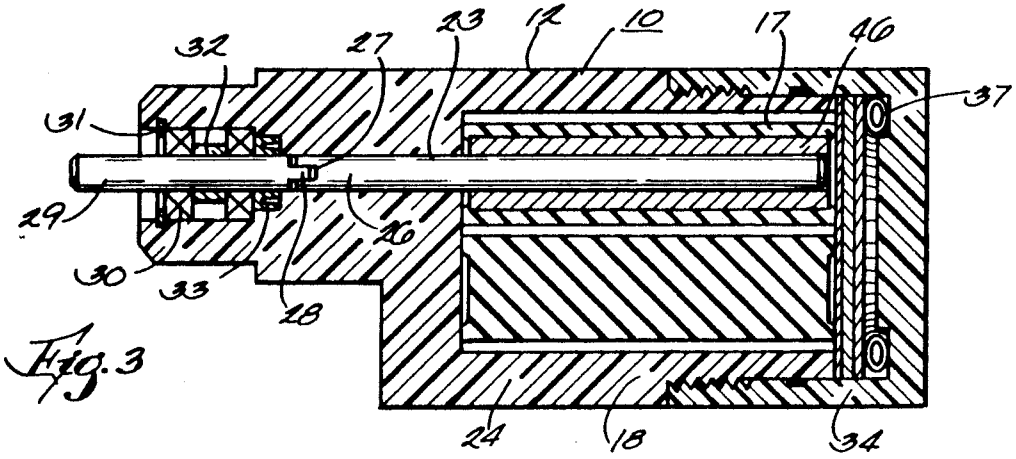
FIG. 3 is a horizontal cross-sectional view taken generally along line 3—3 of FIG. 1.
Figure 4:
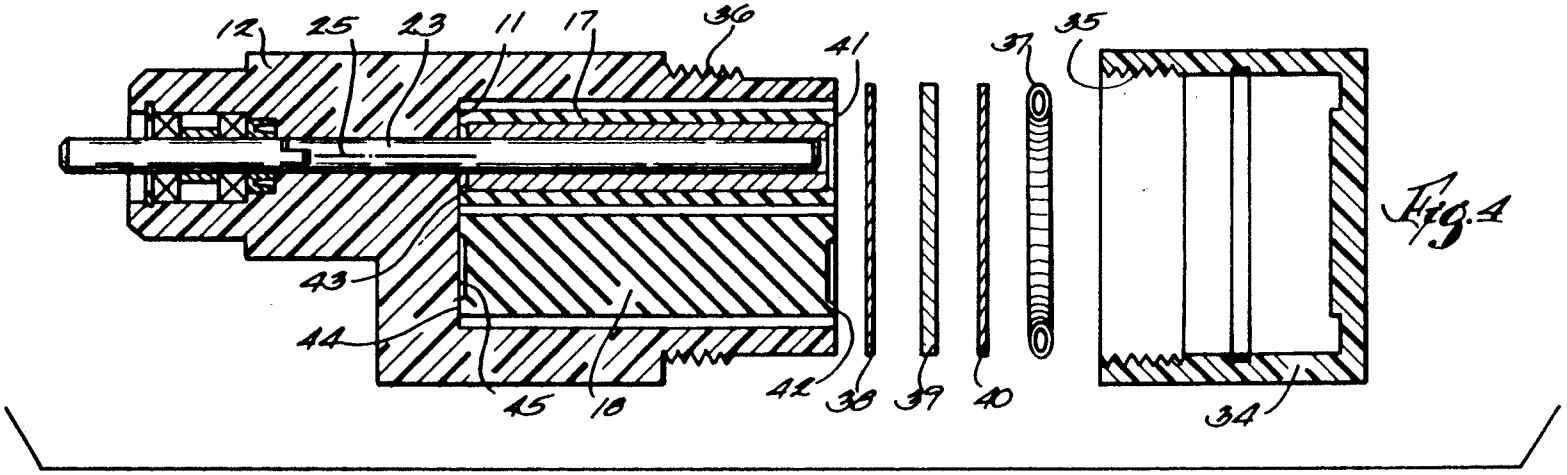
FIG. 4 is an exploded disassembled view of the pump of the present invention illustrating the assembly of the elastomer gears and illustrating, particularly, the housing, the sealing members, and the closure cap.
Figure 9:
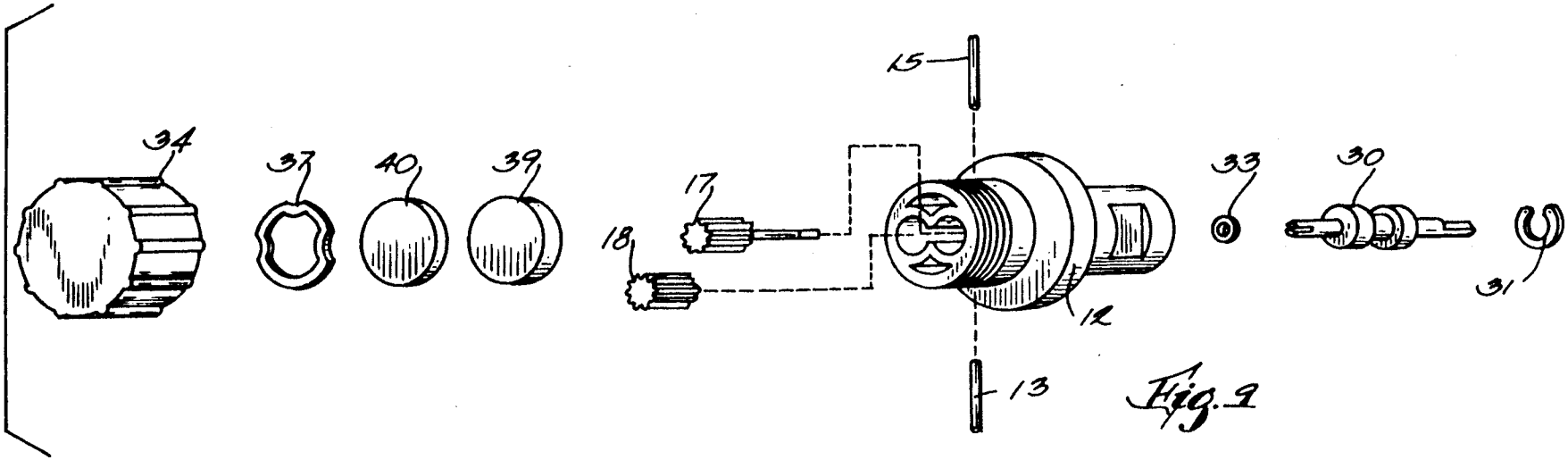
FIG. 9 is an exploded view of the pump of the present invention, similar to the sectional view of FIG. 4.

A spring 37 is inserted into the cap 34, as shown in FIG. 3, and forces a plurality of sealing-members 38, 39 and 40 against the outboard ends 41 and 42 of the gears 17 and 18 respectively.

Because of the material of which the gears 17 and 18 are made, the fluid which is drawn into the cavity 11 does not leak between the ends 41–42 of the gears, at the outboard end, or between the ends 43–44 and the adjacent face 45 of the cavity 11.

Monsanto's thermoplastic elastomer SANTOPRENE is a preferred material for viable gear products intended for water service. Its performance and durability are exceptional. for this application, it is superior to dozens of other elastomers (mostly thermosets) and it meets requirements for both chemical and fatigue resistance.

Figure 2:
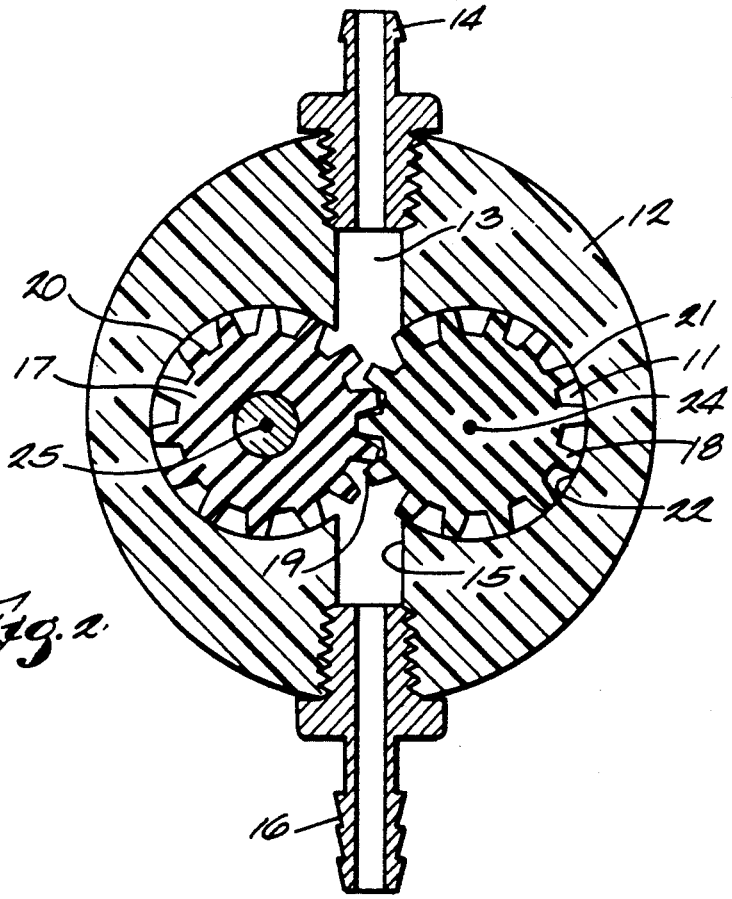
FIG. 2 is a vertical cross-section taken generally along line 2—2 of FIG. 1.

Thus when a motor (not shown) drives the shaft 29, causing the shaft 23 with its gear 17 to rotate, it turns the gear 18 by virtue of a contact between the faces of the teeth of the gears 17 and 18, and inasmuch as the gears are rotating in the direction of the arrow shown in FIG. 2, the fluid moves with the counter-clockwise rotating gear 17 and the clockwise-rotating gear 18 to be drawn from the port 13 and discharged through the port 15.

The graphs shown in FIGS. 5 and 6 illustrate the superior operation of the pump of the present invention in its ability to dispense microliter volumes and control microflows with linearity down to zero rpm. Those shown in FIGS. 7 and 8 demonstrate performance of larger capacity pumps in a one-design family of the present invention.

The main characteristic of the elastomer gear assembly which permits the microflow operation of this pump at extremely low speeds is the ability of the gears to rotate with only moderate friction or resistance while yet maintaining compressive interference of the tips of the gear teeth and of gear ends with the gear-housing, and also in the gear mesh, to provide dynamic sealing engagement throughout the pump assembly.

A unique aspect of the invention is the capability of external gears formed with suitable bulk elastomer (e.g., SANTOPRENE) to drive substantial loads reliably and durably without need of common shafted rigid timing gears or buttressed rubber teeth to carry imposed loads.

Thus it can be seen that I have provided a new and novel, unique and improved microflow gear pump which can operate in low RPM ranges not possible with the pumps of the prior art.

It is furthermore to be understood that the present invention may be embodied in other specific forms without departing from the spirit or special attributes, and it is, therefore, desired that the present embodiments be considered in all respects as illustrative and, therefore, not restrictive, reference being made to the appended claims rather than to the foregoing description to indicate the scope of the invention.

Having thus described the invention, what is claimed as new and desired to be protected by letters Patent are the following:

1. In a rotary gear pump having a housing, a cavity having an inner wall in said housing, and inlet and outlet conduits connecting said cavity with the exterior of said housing, a pair of toothed, meshed gears made of resilient elastomer material and rotatably mounted in said housing with the tooth tips of both gears being in interfering contact with each other and with the inner wall of said cavity, a fluid-tight contact between the tooth tips of the gears and the inner wall of said cavity and also between the line of contact between the two gears, the first of said gears having a shaft with an axis about which the gear rotates, the second of said gears having no shaft on which to rotate and being rotatably driven by the first gear, the diameter of the periphery of the tips of the gear teeth when not disposed in said cavity being greater than the diameter of the said cavity.

2. The rotary gear pump of claim 1 wherein said toothed meshed gears are made of bulk rubber.

3. The rotary gear pump of claim 1 wherein the length of the toothed gears, when not disposed in said cavity, is greater than the length of said cavity.

4. The rotary gear pump of claim 1 wherein said toothed meshed gears are made of bulk elastomer.

5. In a rotary gear pump having a housing, a cavity having an inner wall in said housing, and inlet and outlet conduits connecting said cavity with the exterior of said housing, a pair of toothed, meshed gears made of resilient elastomer material and rotatably mounted in said housing with the tooth tips of both gears being in interfering contact with each other, a fluid-tight contact between the tooth tips of the gears and the inner wall of said cavity and also between the line of contact between the two gears, the first of said gears having a shaft with an axis about which the gear rotates, the second of said gears having no shaft on which to rotate and being rotatably driven by the first gear, the diameter of the periphery of the tips of the gear teeth when not disposed in said cavity being greater than the diameter of the said cavity.

6. In a rotary gear pump having a housing, a cavity having an inner wall in said housing, and inlet and outlet conduits connecting said cavity with the exterior of said housing, a pair of toothed, meshed gears made of resilient elastomer material and rotatably mounted in said housing with the tooth tips of both gears being in interfering contact with the inner wall of said cavity, a fluid-tight contact between the tooth tips of the gears and the inner wall of said cavity and also between the line of contact between the two gears, the first of said gears having a shaft with an axis about which the gear rotates, the second of said gears having no shaft on which to rotate and being rotatably driven by the first gear, the diameter of the periphery of the tips of the gear teeth when not disposed in said cavity being greater than the diameter of the said cavity.

* * * * *